United States Patent [19]

Yamamoto et al.

[11] Patent Number: 4,724,046

[45] Date of Patent: Feb. 9, 1988

[54] CAKE OF SYNTHETIC FIBRID

[75] Inventors: Michio Yamamoto; Akihiro Aoki; Noriaki Sasaki, all of Iwakuni, Japan

[73] Assignee: Teijin Limited, Osaka, Japan

[21] Appl. No.: 846,255

[22] Filed: Mar. 31, 1986

Related U.S. Application Data

[63] Continuation-in-part of Ser. No. 717,549, Mar. 29, 1985, abandoned.

[51] Int. Cl.[4] ..... D21D 3/00

[52] U.S. Cl. ..... 162/100; 162/157.2; 162/218; 264/117; 264/118

[58] Field of Search ..... 162/157.2, 157.3, 157.4, 162/157.5, 9, 100, 182, 218; 264/86, 117, 118

[56] References Cited

U.S. PATENT DOCUMENTS

| | | | |
|---|---|---|---|
| 3,123,518 | 3/1964 | Bundy | 162/157.3 |
| 3,891,499 | 6/1975 | Kato et al. | 162/157.5 |
| 3,950,293 | 4/1976 | Sander et al. | 162/157.5 |

*Primary Examiner*—Peter Chin

*Attorney, Agent, or Firm*—Burgess, Ryan & Wayne

[57] ABSTRACT

A cake of synthetic fibrid, which is formed by pressing to hydroextract a slurry of synthetic fibrid, pulverizing the compression product, and compressing the pulverization product again to solidity it in the form of a plate-like cake.

7 Claims, 3 Drawing Figures

CAKE OF SYNTHETIC FIBRID

CROSS-REFERENCE TO RELATED APPLICATION

This application is a continuation-in-part of application Ser. No. 717,549, filed on Mar. 29, 1985, now abandoned.

BACKGROUND OF THE INVENTION (1) Field of the Invention

The present invention relates to a cake of synthetic fibrid which is easy to handle and excellent in adaptability to the papermaking operations and which can be formed into a paper product having excellent properties.

(2) Description of the Related Art

Preparation of pulpy particles called "fibrid" from various synthetic polymers are known and described in the specifications of U.S. Pat. No. 2,988,782 and U.S. Pat. No. 2,999,788.

According to these known techniques, fibrids are prepared by dissolving a fiber-forming polymer such as an acrylonitrile type polymer, nylon, or polyethylene terephthalate in a solvent for the polymer to form a polymer solution (dope) and causing precipitation in the polymer solution under a strong shearing action in a precipitating agent which is a non-solvent for the polymer and has affinity with the solvent.

As the precipitating apparatus for preparing fibrids, a precipitating apparatus comprising a rotor and a stator in combination is disclosed in Japanese unexamined patent publication (Kokai) No. 52-15621 and U.S. Pat. No. 3,018,091. The apparatus disclosed in Japanese unexamined patent publication No. 52-15621 is preferred because good fibrids can be prepared at a high efficiency.

In each of the known methods, a precipitated fibrid is dispersed in the precipitating agent to form a slurry. Since the fibrid per se has a good liquid-retaining property, even after the washing liquid is separated at the washing step, a large amount of the washing liquid is left in the interior of the fibrid and/or in the spaces among individual fibrids. Accordingly, even if the washing operation is carried out repeatedly, the washing effect is low and complete washing is almost never attained. Research has confirmed that even after hydroextraction (hereinafter, may be referred to as "dehydration"), water containing a large amount of a solvent is left in the fibrid aggregate in an amount 10 to 30 times the amount of the fibrid (as solids). Even if this fibrids is washed by using water in an amount 100 times of the amount of the fibrid according to the above-mentioned method, the amount of the residual solvent is merely reduced to ⅓ to 1/10 of the original amount.

The so-washed fibrid is hydroextracted by a vacuum filter, such as a Nutsche filter, to obtain a product. If hydroextraction is strictly carried out at this step, it is difficult to redisperse the fibrid in water at the subsequent step. Even if this fibrid is subjected to a papermaking operation, the touch and physical properties of the resulting paper-like product are poor and it is difficult to obtain a good paper-like product.

For example, a solution of a poly-m-phenyleneisophthalamide polymer in N-methyl-2-pyrrolidone (sometimes referred to as "NMP" hereinafter) is prepared. An aqueous solution of NMP is prepared as a precipitating agent. The two solutions are introduced into the apparatus disclosed in Japanese unexamined patent publication No. 52-15621 to precipitate the polymer. When the fibrid is washed with water, filtered, and compressed as a mass to various water contents, it is seen that if the average moisture in the pulp bale is smaller than 4 times the amount of the fibrid (the absolutely dry weight of the fibrid as solids), the dispersibility of the fibrid at the papermaking step is poor and the physical properties of the resulting paper-like product are inferior. Accordingly, the fibrid is practically hydroextracted to such an extent that the amount of water is about 4 to 5 times the amount of the fibrid. If the dehydration degree is further increased, a paper-like product having good properties cannot be obtained.

However, a fibrid aggregate containing such a large amount of water is difficult to handle and the transportation cost is extremely high. Moreover, there is a risk of deformation or breakage of the aggregate form during the transportation or there is risk of evaporation or leaking of water. Accordingly, it has been considered that fibrids are not suitable for long-distance transportation. This disadvantage has heretofore been obviated by conducting a fibrid-preparing process and a papermaking process in one factory or in adjoining factories.

Recently, use of a synthetic fibrid as a frictional member has been proposed (see U.S. Pat. No. 4,324,706) as means for solving the problem of environmental pollution by asbestos, and special molding has been adopted for preparing a paper-like insulating material from a synthetic fibrid. As uses and application methods of synthetic fibrids have thus been diversified, it often happens that a papermaking factory or other processing factory is not located in the same place as the location of a fibrid-preparing factory. Accordingly, development of a synthetic fibrid being capable of reducing the transportation cost, having a good handling property at the tim time of transportation and causing no trouble at a fibrid-processing step such as a papermaking step is eagerly desired.

SUMMARY OF THE INVENTION

It is a primary object of the present invention to satisfy the above desire in the art and provide a cake-like fibrid aggregate, the transportation cost of which is cheap and which is excellent in the handling property it the time of transportation and is easily used at a fibrid-processing step such as a papermaking step.

Another object of the present invention is to provide a cake-like fibrid aggregate which can be formed into paper-like products excellent in physical properties, especially strength, elongation, and electrical insulating property, by mixing it with various fibers and subjecting the mixtures to the papermaking operation.

Still another object of the present invention is to provide a cake-like fibrid aggregate which can be washed at the washing step with a relatively small amount of a washing liquid.

These objects of the present invention can be attained by a cake of synthetic fibrid, which is formed by pressing to hydroextract a slurry of synthetic fibrid, pulverizing the pressed product, and compressing the pulverization product again to form a solid plate-like cake.

DESCRIPTION OF THE PREFERRED EMBODIMENTS

Figure 1:
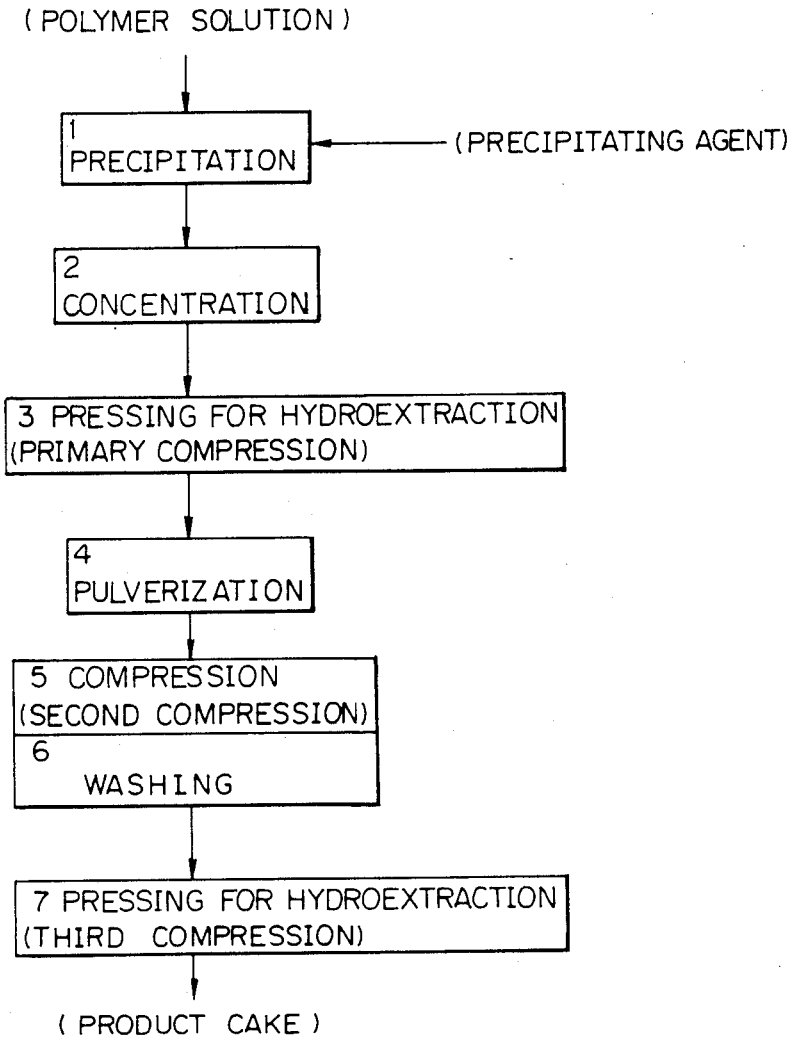
FIG. 1 is a process flow chart showing an embodiment of the process for preparing the synthetic fibrid cake of the present invention and FIGS. 2A and 2B are perspective views showing examples of the shape of the synthetic fibrid cake of the present invention.

In the present invention, a synthetic fibrid-forming polymer is optionally selected among various fiber-forming polymers. For example, at least one member selected from hard polymers and soft polymers disclosed in U.S. Pat. No. 2,988,782 may be used. Among them, an aromatic polyamide excellent in the heat resistance and flame retardancy is especially preferred.

As examples of the aromatic polyamide preferred as the synthetic fibrid-forming polymer, the following aromatic polyamides can be mentioned.

(a) A condensed polyamide of highly active derivative of dicarboxylic acid, preferably an acid halide, with a diamine having an aromatic ring.

For example, there can be mentioned a homopolyamide or copolyamide obtained by reacting substantially equimolar amounts of at least one dicarboxylic acid selected from isophthalic acid and terephthalic acid and at least one diamine selected from m-phenylene diamine, p-phenylene diamine, 3,4'-diminodiphenyl ether, 4,4'-diaminodiphenyl ether, 3,4'-diaminodiphenylmethane, 4,4'-diaminodiphenylmethane, xylylene diamine, and N-methyl-p-phenylene diamine. As the most preferred condensed polyamide, there can be mentioned poly-m-phenylene-isophthalamide and a copolymer of m-phenyleneisophthalamide and m-phenylene-terepthalamide.

(b) A polyamide obtained by condensing an aromatic ring-containing aminocarboxylic acid, preferably after activation.

For example, there can be mentioned a homopolyamide obtained by using p- or m-aminobenzoic acid or p-aminomethylbenzoic acid as the amincarboxylic acid or a copolyamide obtained by copolycondensing at least two aminocarboxylic acids. As the preferred condensed polyamide, there can be mentioned polp(p-aminobenzoic acid).

(c) A polyamide obtained by copblycondensing the above-mentioned polyamides (a) and (b).

As the preferred copolycondensed polyamide, there can be mentioned a copolyamide formed by copolycondensation of m-phenylene-diamine, isophthaloyl chloride, and p-aminobenzoic acid chloride.

In addition to the above-mentioned aromatic polyamides, polyamide-imides, polyimines, polybenzimidazoles, polycarbonates, ald other polymers having a good heat resistance can be preferably used as the polymer.

In order to improve the electric characteristics and impregnating property of a paper-like product, mica particles or fine particles of other inorganic substances may be incorporated into the polymer.

As the method for preparing a synthetic fibrid from a polymer as mentioned above, there can be mentioned a method in which a synthetic fibrid (pulpy particle) is prepared according to the wet method as disclosed in U.S. Pat. No. 2,988,782, and a method in which a fiber or film capable of being easily fibrilated is mechanically beaten to form a fibrid (pulpy particle) as disclosed in Japanese unexamined patent publication No. 51-82028. Adoption of the wet method is especially preferred. More specifically, there is preferably adopted a method in which a solution of the polymer is introduced into a precipitating agent which is a non-solvent for the polymer and has an affinity with a solvent of the solution. The polymer is precipitated while imposing a shearing action on the solution.

In preparing a fibrid according to the wet method, the solvent for the polymer should be appropriately selected according to the kind of the polymer. In the case where the polymer is an aromatic polyamide, there are used inorganic solvents such as sulfuric acid and hydrogen fluoride and organic solvents such as N-methyl-2-pyrrolidone (NMP), N,N'-dimethylformamide (DMF), N,N'-dimethylacetamide (DMA), dimethylsulfoxide (DMSO), and tetramethylurea (TMU).

In case of a poly-m-phenylene-isophthalamide type polymer, a polar amide type solvent such as NMP or DMA is especially preferred. When such a polar amide type solvent is used, in order to improve the polymer-dissolving power, an inorganic salt such as calcium chloride or lithium chloride may be incorporated in the solvent, if necessary. However, since an aromatic polyamide, especially a poly-m-phenylene-isophthalamide type polymer, prepared according to the interfacial polymerization process disclosed in U.S. Pat. No. 3,640,970, is characterized in that an inorganic salt such as mentioned above is not incorporated into the polymer at the polymerization step and the solubility in a polar amide type solvent is good, the inorganic salt need not be added at the dissolving step. This polymer is advantageous when a substantially inorganic salt-free fibrid is prepared.

The polymer concentration in the solution is changed according to the kind or polymerization degree of the polymer, but it is ordinarily preferred that the polymer concentration be 2% to 20% by weight, especially 3% to 15% by weight.

A solution having affinity with the solvent in the polymer solution and being a non-solvent for the polymer is used as the precipitating agent. As the precipitating agent that can be used when an organic solvent is used as the solvent, there can be mentioned water, a water/organic solvent liquid mixture, glycerol, ethylene glycol, a glycerol/water liquid mixture, and ether. An inorganic salt such as calcium chloride or lithium chloride may be incorporated into the precipitating agent according to need.

As the precipitating agent for a polymer solution formed by dissolving a poly-m-phenylene-isophthalamide type polymer in a polar amide solvent such as mentioned above, there is preferably used an aqueous solution containing up to 50% by weight, especially about 10% to about 40% by weight, of the above-mentioned solvent.

In preparing a fibrid, it is indispensable to use an apparatus in which the precipitating agent is stirred at a high speed, whereby the solvent is removed from the polymer solution introduced into the precipitating agent and, simultaneously, a strong shearing action is given to the polymer solution. A continuous precipitating apparatus comprising a stator having a specific shape and a turbine vane type rotor, as disclosed in Japanese unexamined patent publication No. 52-15621, is especially preferred.

From the results of our research, it was confirmed that if the precipitation system is formed into a mixed phase of a gas and a liquid in preparing a fibrid according to the wet method, the power necessary for the production of a fibrid can be greatly reduced and the deviation of the particle size in the desired fibrid can be reduced. A paper prepared from this fibrid has excellent properties. In this precipitation system, if desired, the liquid precipitating agent may be mixed with a gas so that the amount of the gas is 5% to 100% by volume, especially 10% to 50% by volume, based on the liquid. Air is most preferred from the economical viewpoint, but other inert gases such as carbon dioxide gas and nitrogen may be used.

Formation of the precipitation system into a gas/liquid mixed phase can be accomplished by incorporating or dissolving the gas into the precipitating agent in advance and introducing the mixture into the precipitating apparatus, or by introducing the gas into the precipitating apparatus simultaneously with the precipitating agent and the polymer solution. The gas may be introduced in the compressed state. Furthermore, the apparatus may be contrived so that the gas (air) is sucked into the precipitating apparatus from the outside or there may be adopted a method in which the gas is dissolved in the precipitating agent and the gas is generated at the precipitating step.

In a precipitating apparatus of the type disclosed in Japanese unexamined patent publication No. 52-15621, an especially high effect is attached if the rotor is rotated at a high speed, for example, 5000 rpm or higher, and the gas is incorporated and made present in the precipitation system to which a very large shearing force is applied.

In the present invention, the synthetic fibrid prepared, for example, according to the above-mentioned method, takes the form of a slurry. This fibrid slurry is pressed for hydroextraction (primary compression) to from a plate-like cake. This cake is pulverized to form granules or flakes and these granules or flakes are pressed (second compression) again to obtain a solid plate-like cake.

This caking operation may be carried out after washing of the fibrid, but from the industrial viewpoint, it is preferred that washing of the fibrid be carried out during the caking operation.

For example, there is preferably adopted a method in which the synthetic fibrid slurry obtained according to the wet method is first pressed for hydroextraction (primary compression), the obtained cake is mechanically pulverized to form granules or flakes, the granules or flakes are pressed (second compression) again, and a washing liquid is forcibly dashed on the fibrid layer in the compressed state to effect substitution washing.

The degree of primary compression may be such that the amount of the liquid contained in the fibrid is reduced to 1 to 10 times the absolutely dry weight of the fibrid (as solids). The degree of second compression may be such that the amount of the liquid is reduced to 0.5 to 6 times the absolutely dry weight of the fibrid.

Water at normal temperature or heated water is ordinarily used as the washing liquid, but other washing liquid may be used according to the kind of the fibrid to be washed. It is preferred that the washing liquid be passed through the compressed fibrid in an amount 5 to 30 times the amount of the fibrid over a period of about 5 to about 30 minutes for one washing operation and that the pressure of the washing liquid be 3 to 70 $kg/cm^2$, especially 10 to 60 $kg/cm^2$.

The frequency of the washing operation is not limited to one time, but the washing operation may be carried out repeatedly.

If the above-mentioned washing method is adopted, the washing efficiency is high and washing is completed with a realtively small amount of the washing liquid.

The fibrid which has been thus washed during the caking process is subjected to additional pressing for hydroextraction (third compression) according to need, and the fibrid is withdrawn in the form of a solid plate-like cake.

The process flow of the preferred embodiment of the present invention in which substitution washing is effected during the cake-forming process is illustrated in FIG. 1. Referring to FIG. 1, a fibrid formed at a precipitating step 1 is taken out in the form of a slurry and is concentrated at a concentration step 2 by a rotary sieving filter or the like. The slurry is compressed and hydroextracted at a primary compression step 3 to form a plate-like primary cake in which the amount of the liquid is 1 to 10 times, preferably about 2 to about 6 times, the amount of the fibrid. The cake is then pulverized to granules or flakes having a size of about 1 to about 5 mm at a pulverization step 4, and the granules or flakes are hydroextracted at a second compression step 5 so that the amount of the liquid is 0.5 to 6 times preferably about 1.0 to about 3 times, the amount of the fibrid. In this state, a washing liquid is forcibly introduced under pressure to effect substitution washing 6.

The so-washed fibrid takes the form of a solid plate-like cake. This cake may be withdrawn as a product but it may be further dehydrated, if necessary, at a third compression step 7 to form a product.

Incidentally, the present invention is not limited to the above embodiment in which substitution washing is effected in the compressed state. The precipitated fibrid may be first mix-washed and then subjected to primary compression, pulverization, and second compression as described above, or there may be adopted a method in which mix-washing is carried out after second compression and then, third compression is carried out to obtain a cake.

Figure 2A:
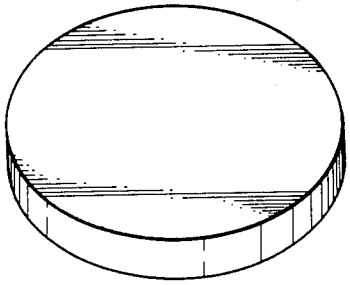
Figure 2B:
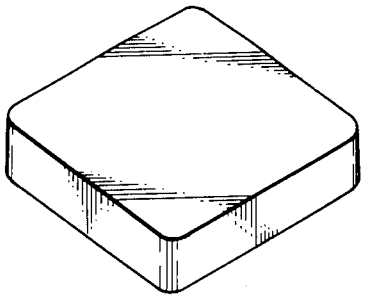

The shape of the product cake is not particularly critical. For example, the product cake may have a disc-like shape, a square plate-like shape, or other optional shape. FIG. 2 is a perspective view showing examples of the shape of the product cake, in which FIG. 2A shows a disc-like cake and FIG. 2B shows a cake having a corner-rounded square shape.

The thickness of the cake is preferably about 1 to about 10 cm. In the case of a disc-like cake as shown in FIG. 2A, the diameter is preferably 10 to 100 cm. In the case of a square cake as shown in FIG. 2B, the length of one side is preferably 10 to 100 cm, because the cake is easily handled.

The cake is transported to a papermaking factory. In the papermaking factory, beating and refining treatments are performed to adjust the size of the fibrid according to need and the fibrid is subjected to the papermaking operation. In view of the adaptability to the papermaking operation and the physical properties of a paper-like product, it is preferred that the content of fine particles (fibrids) capable of passing through a 150-mesh sieve be lower than 20% by weight, the content of coarse particles incapable of passing through a 24-mesh sieve be lower than 10% by weight, the content of particles incapable of passing through a 150-mesh sieve but capable of passing through a 24-mesh sieve be higher than 50% by weight and the beating degree (freeness) be adjusted to 55° to 80° SR where it is to be used for electrical insulating materials. The beating degree may be adjusted to lower than 55° SR for the other material.

The above-mentioned synthetic fibrid cake can be easily redispersed in water. Beating and refining are carried out according to need. The resulting slurry can be formed into a paper product having a high quality. In this case, the fibrid may be mixed with a heat-resistant fiber, for example, an aromatic polyamide fiber such as a poly-m-phenylene-isophthalamide fiber or a poly-p-phenylene-terephthalamide fiber.

This synthetic fibrid cake has a good handling property and can withstand a long-period storage or transportation.

It is considered that these effects are due to the fact that after first compression, the directionality of the fibrid layer formed by the compression is disturbed while it is pulverized and during second compression of the pulverization product, the fibrid layer is further randomly oriented and the product obtained by second compression takes the form that will be easily redispersed at the subsequent step. Accordingly, even if the randomly oriented fibrid cake is pulverized again, only reduction of the size of masses occurs. Therefore, it is considered that the pulverization product has similar merits.

Incidentally, in case of a cake of a fibrid of an aromatic polyamide, if a polymer prepared according to the interfacial polymerization process is used as the starting polymer, there can be obtained a cake substantially free of an inorganic salt.

The present invention will now be described in detail with reference to the following examples. Although aromatic polyamides are used as the fibrid-forming polymer in these examples, the effects of the present invention are not influenced by the difference of the kind of the starting substance. Therefore, the scope of the present invention is not limited by these examples at all.

Incidentally, in the examples, all of "%" and "parts" are by weight, unless otherwise indicated.

EXAMPLE 1

A polymer obtained by polymerizing 5 molar parts of terephthaloyl chloride, 95 molar parts of isophthaloyl chloride, and 100 molar parts of m-phenylene diamine in tetrahydrofuran as a solvent according to the process disclosed in U.S. Pat. No. 3,604,970 was separated, washed with water, and dried and was then dissolved in N-methyl-2-pyrrolidone (NMP) to form a solution having a concentration of 12.5%. The intrinsic viscosity (as measured in NMP at 30° C.) of the polymer was 1.3.

Separately, a 30% aqueous solution of NMP was prepared, and this solution was used as a precipitating agent.

The polymer solution and the precipitating agent were fed into a precipitating apparatus having a structure disclosed in Japanese unexamined patent publication No. 52-15621, in which the rotor was rotated at a speed of 10000 rpm and had a diameter of 150 mm, so that the volume ratio of the polymer solution to the precipitating agent was 1/30, whereby a fibrid of an aromatic polyamide having main recurring units composed of m-phenylene-isophthalamide was obtained.

The obtained fibrid had a Schopper-Riegler beating degree of 61.5° as determined according to the method of Japan Industrial Standard (JIS) P-8212, and the results of the sieving test were as follows.

150-mesh passing fraction: 6.3%
80–150 mesh: 7.8%
48–80 mesh: 16.9%
24–48 mesh: 37.2%
24-mesh not-passing fraction: 32.8%

The fibrid was washed with water and charged in a compressing apparatus. The fibrid was pressed and hydroextracted so that the water/fibrid weight ratio was 3/1. The apparatus used had an inner diameter of 100 mm and comprised a filter including a perforated plate and a sintered metal laminated on the perforated plate, which was arranged in the bottom portion of the apparatus. This compressing apparatus comprised a piston of the same laminate structure which was arranged in the top portion.

The obtained fibrid cake was roughly crumbled by hand and pulverized by a household mixer.

The pulverization product was pressed again by using the same compressing apparatus as described above so that the water/fibrid weight ratio was 2/1, whereby a disc-shaped cake was obtained.

A part of the obtained fibrid cake was charged in a household mixer together with water. Mixing and dispersing were carried out at a voltage of 70 V. Water containing, dispersed therein, a short fiber ("TEIJINCONEX", manufactured by TEIJIN LIMITED) of the same polymer as described above, having a titre of 2 denier and a length of 4 mm, was added to the above dispersion, followed by mixing. A paper having a basis weight of 110 g/m$^2$ was formed from this liquid mixture by the hand papermaking operation. This paper had a good texture. The obtained paper was pressed at about 300° C. under 200 kg/cm$^2$ for 2 minutes. The physical properties of the obtained heat-pressed paper were as follows.

Strength: 8.7 kg/mm$^2$
Elongation: 19.8%
BDV (insulation breakdown voltage): 32.5 kV/mm

COMPARATIVE EXAMPLE 1

The same fibrid as used in Example 1 was washed with water and was forcibly compressed by the same compressing apparatus as used in Example 1. The fibrid could be dehydrated only to such an extent that the water/fibrid weight ratio was 1.8/1.

The fibrid cake was broken, and a part of the broken cake was treated and formed into a paper in the same manner as described in Example 1. Many particulate convexities were left on the surface of the obtained paper product. The paper product was pressed in the same manner as described in Example 1. The BDV value of the obtained paper are 16 kV/mm.

EXAMPLE 2

A poly-m-phenylene-isophthalamide polymer having an intrinsic viscosity (as measured in NMP at 30° C.) of 1.35 was dissolved in NMP to form a solution having a polymer concentration of 12.5%.

Separately, a 30% aqueous solution of NMP was prepared, and this solution was used as a precipitating agent.

In the same manner as described in Example 1, the polymer solution and the precipitating agent were fed into a precipitating apparatus having a structure disclosed in Japanese unexamined patent publication No. 52-15621, in which the rotor was rotated at a speed of 10,000 rpm and had a diameter of 150 mm, so that the solution/precipitating agent volume ratio was 1/30, whereby a fibrid of poly-m-phenylene-isophthalamide was obtained. The obtained fibrid was pressed and hydro-extracted (primary compression) by an apparatus disclosed in Japanese patent application No. 59-1884, having an inner diameter of 300 mm, to obtain a cake where the water/fibrid weight ratio was 4/1. The obtained cake was roughly pulverized and was further pulverized by a pulverizer to an average particle size of about 1 to about 3 mm.

The obtained granular aggregate of the fibrid was charged again in the apparatus disclosed in Japanese patent application No. 59-1884 and pressed again (second compression) so that the water/fibrid weight ratio was 2.5/1. Then, water in an amount 10 times the weight of the as-compressed fibrid was forcibly passed through the fibrid layer to effect water washing.

The water-washed fibrid was pressed and hydroextracted (third compression) so that the water/fibrid weight ratio was 1.5/1.

The obtained fibrid cake was pulverized, treated by a beater, and treated by a disk refiner so that the freeness (Schopper-Riegler beating degree) was 65°. Then, 60 parts of the fibrid was mixed with 40 parts of a short fiber ("TEIJINCONEX") of poly-m-phenyleneisophthalamide having a titre of 2 denier and a length of 4 mm. The mixture was formed into a paper and the paper was heat-pressed at 300° C. under 200 kg/cm$^2$ to obtain a paper having the following physical properties.

Strength: 8.2 kg/mm$^2$
Elongation: 19.5%
BDV: 32.8 kV/mm

EXAMPLE 3

The fibrid prepared in the same manner as described in Example 2 was sufficiently washed with water. In the same manner as described in Example 2, the fibrid was pressed and hydroextracted (primary compression) by the apparatus disclosed in Japanese patent application No. 59-1884 and roughly pulverized. Then, the fibrid was pulverized by a pulverizer supplied by Horai Tekkosho and the pulverized fibrid was compressed again (second compression) by the above-mentioned compression apparatus to obtain a fibrid cake.

The cake was crumbled by hand and was treated by a beater and a disk refiner in the same manner as described in Example 2 so that the freeness (Schopper-Riegler beating degree) was 67°. Then, 60 parts of the fibrid was mixed with 40 parts of the short fiber of poly-m-phenylene-isophthalamide having a titre of 2 denier and a length of 4 mm and the mixture was formed into a paper. The paper was heat-pressed at 300° C. under 200 kg/cm$^2$ to obtain a paper having the following physical properties.

Strength: 8.4 kg/mm$^2$
Elongation: 20.1%
BDV: 34.0 kV/mm

EXAMPLE 4

The fibrid cake obtained in Example 1 (the fibrid cake obtained by washing the fibrid obtained by precipitation with water, compressing to hydroextract the fibrid, pulverizing the fibrid cake, and compressing the pulverization product again) was stored at room temperature for 6 months. Then, the fibrid cake was dispersed by a household mixer in the same manner as described in Example 1. Then, 60 parts of the fibrid was mixed with 40 parts of a short fiber ("TEIJINCONEX") of poly-m-phenylene-isophthalamide having a titre of 2 denier and a length of 4 mm. The mixture was formed into a paper and the paper was heat-pressed to obtain a paper having the following physical properties.

Strength: 8.5 kg/mm$^2$
Elongation: 20.4%
BDV: 32.4 kV/mm

The above-mentioned cake was stored at 50° C. for 6 months. The papermaking and heat-pressing operations were carried out in the same manner as described above to obtain a paper having the following physical properties.

Strength: 8.2 kg/mm$^2$
Elongation: 18.9%
BDV: 31.8 kV/mm

In each case, the papermaking and heat-pressing operations were carried under the same conditions as described in Example 1.

EXAMPLE 5

According to the method disclosed in U.S. Pat. No. 3,640,970, a solution of 5 molar parts of terephthaloyl chloride and 95 molar parts of isophthaloyl chloride in tetrahydrofuran was gradually added with stirring to a solution of 100 molar parts of m-phenylene diamine in tetrahydrofuran to prepare an aromatic polyamide. The polymer was neutralized, washed with water, dried, and dissolved in NMP to form a solution having a polymer concentration of 12.5%. By using the apparatus disclosed in Japanese unexamined patent publication No. 52-15621, the polymer solution was mixed with an aqueous solution containing 30% by weight of NMP to precipitate the polymer, whereby a fibrid was obtained.

The starting fibrid slurry prepared through the above-mentioned fibrid-preparing step was pressed and hydroextracted (primary compression) in a cylindrical pressure vessel having perforated plates of a sintered metal arranged in the top and bottom portions so that the average moisture in the pulp bale was 86% (the water/fibrid weight ratio was 6/1).

The compressed and dehydrated fibrid cake was pulverized in a pulverizer to form granules having an average particle size of about 3 mm. The granules were charged in the above-mentioned vessel again and compressed (second compression) so that the average moisture of the pulp bale was 75% (the water/fibrid weight ratio was 3/1).

Then, 240 parts by weight of water was introduced under pressure into the so-formed cake layer comprising 40 parts by weight of the fibrid and 120 parts by weight of water while continuing compression (pressing) and passed through the cake layer to effect water washing. After completion of circulation of water, the cake layer comprised 40 parts by weight of the fibrid and 120 parts of water.

The water-washed fibrid cake was solid and had a disc-like shape. The average content of residual NMP in the cake was 2.4% by weight, no inorganic salt was substantially contained in the cake.

After water washing, the fibrid cake was further compressed (third compression), whereby the average moisture of the polp bale was reduced to 50% (the water/fibrid weight ratio was 1/1).

The fibrid cake was dispersed by a pulverizer so that the beating degree was 60° SR. In the resulting 0.2% by weight slurry, the same poly-m-phenylene-isophthalamide fiber ("TEIJINCONEX") as used in Example 1 was incorporated and dispersed in an amount of 40 parts per 60 parts of the fibrid, and the mixture was formed into severals paper-like sheets having a basis weight of 120 g/mm². The sheets were heat-pressed at 280° C. to obtain paper products having a tensile strength of 7.2 to 7.8 kg/mm², an elongation at break of 18% to 20%, and a BDV value of 28 to 32 kV/mm.

EXAMPLE 6

A polymer obtained by polymerizing 5 molar parts of terephthaloyl chloride, 95 molar parts of isophthaloyl chloride, and 100 molar parts of m-phenylene diamine in tetrahydrofuran as a solvent according to the process disclosed in Japanese examined patent publication No. 47-10863 was separated, washed with water, and dried and was then dissolved in N-methyl-2-pyrrolidone (NMP) to form a solution having a concentration of 12.5%. The intrinsic viscosity (as measured in NMP at 30° C.) of the polymer was 1.35.

Separately, a 30% aqueous solution of NMP was prepared, and this solution was used as a precipitating agent.

The polymer solution and the precipitating agent were fed into a precipitating apparatus having a structure disclosed in Japanese unexamined patent publication No. 52-15621, in which the rotor was rotated at a speed of 10000 rpm and had a diameter of 150 mm, so that the volume ratio of the polymer solution to the precipitating agent was 1/30, whereby a fibrid of an aromatic polyamide having main recurring units composed of m-phenylene-isophthalamide was obtained.

The obtained fibrid had a Schopper-Riegler beating degree of 61.5°, and the results of the sieving test were as follows.

150-mesh passing fraction: 3.8%
80–150 mesh: 4.8%
48–80 mesh: 17.2%
24–48 mesh: 34.6%
24-mesh not-passing fraction: 39.6%

The fibrid was pressed and hydroextracted in a compressing apparatus so that the water/fibrid weight ratio was 5/1. The apparatus used and an inner diameter of 600 mm and comprised a filter including a perforated plate and a sintered metal laminated on the perforated plate, which was arranged in the bottom portion of the apparatus. This compressing apparatus comprised a piston of the same laminate structure which was arranged in the top portion.

The obtained fibrid cake was crumbled. The pulverization product was pressed again by using the same compressing apparatus as described above so that the water/fibrid weight ratio was 4/1.

10 parts of water was forced to flow through the layer of the fibrid cake as compressed to wash the fibrid cake for about 2 minutes. The maximum value of the washing pressure was 20 kg/cm².G. The cake was further compressed so that the water/fibrid weight ratio was 3/1. The amount of the residual solvent (N-methylpyridone) was 2%.

A part of the obtained fibrid cake was charged in a household mixer together with water. Mixing and dispersing were carried out at a voltage of 70 V. Water containing, dispersed therein, a short fiber of the same polymer as described above, having a titre of 2 denier and a length of 4 mm, was added to the above dispersion, followed by mixing. A paper having a basis weight of 110 g/m² was formed from this liquid mixture by the hand papermaking operation. This paper had a good texture. The obtained paper was pressed at about 300° C. under 200 kg/cm² for 2 minutes. The physical properties of the obtained heat-pressed paper were as follows.

Strength: 10 kg/mm²
Elongation: 20%
BDV (insulation breakdown voltage): 32.5 kV/mm

We claim:

1. A proccess for preparing a cake of synthetic fibrids comprising: compressing, to hydroextract, a slurry of fibrids, to form a compression product wherein the amount of a liquid contained in the compression product is 1 to 10 times the absolutely dry weight of the fibrids; pulverizing the compression product containing an amount of liquid 1 to 10 times the absolutely dry weight of the fibrids, to form a pulverulent granular or flake product; and compressing the pulverulent product to form a solid plate-like cake containing an amount of a liquid 0.5 to 6 times the absolutely dry weight of the fibrids.

2. A process of claim 1, wherein the compression product contains an amount of liquid 2 to 6 times the absolutely dry weight of the fibrids.

3. A process as set forth in claim 7, wherein the pulverulent product is compressed so that the amount of the liquid is reduced to 1 to 3 times of the absolutely dry weight of the fibrids.

4. A process of claim 1, wherein the fibrids are washed before the slurry of synthetic fibrids are compressed.

5. A process of claim 1, wherein the fibrids are washed after the pulverulent product is compressed.

6. A process of claim 5, wherein the washed compressed pulverulent product is subjected to further compression.

7. A process as set forth in claim 1, wherein that the compression product is pulverized to granules or flakes having a size of 1 to 5 mm.

* * * * *